US009306327B1

(12) United States Patent
Plaza

(10) Patent No.: US 9,306,327 B1
(45) Date of Patent: Apr. 5, 2016

(54) CLIP FOR WIRE HARNESS

(71) Applicant: Aaron M. Plaza, Canterbury, NH (US)

(72) Inventor: Aaron M. Plaza, Canterbury, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 14/689,780

(22) Filed: Apr. 17, 2015

(51) Int. Cl.
*H01R 13/627* (2006.01)

(52) U.S. Cl.
CPC ..... *H01R 13/6275* (2013.01); *H01R 2201/26* (2013.01)

(58) Field of Classification Search
USPC ..... 439/350, 358, 619, 699.2, 375; 362/546
See application file for complete search history.

(56) References Cited

U.S. PATENT DOCUMENTS

| | | | | |
|---|---|---|---|---|
| 3,324,442 | A * | 6/1967 | Greasley | H01R 33/09 439/57 |
| 3,798,588 | A * | 3/1974 | Howe | H01R 33/465 439/336 |
| 4,114,972 | A * | 9/1978 | Kraus | H01R 33/09 439/375 |
| 5,343,362 | A | 8/1994 | Solberg | |
| 5,709,571 | A * | 1/1998 | Briski | H01R 33/09 439/619 |
| 5,800,183 | A * | 9/1998 | Paul | H01R 33/09 439/557 |
| 5,917,701 | A * | 6/1999 | Solberg | H01L 23/4093 257/E23.086 |
| 6,523,983 | B2 * | 2/2003 | Young, Jr. | B60Q 1/2665 362/267 |
| 7,364,371 | B2 | 4/2008 | Tomikawa et al. | |
| 7,731,545 | B1 * | 6/2010 | Scholeno | H01R 33/05 439/619 |
| 7,993,162 | B1 * | 8/2011 | Scholeno | H01R 13/18 439/619 |
| 8,319,411 | B2 | 11/2012 | Kling et al. | |
| 8,888,521 | B2 * | 11/2014 | Puckett | H01R 13/641 439/352 |
| 9,136,646 | B2 * | 9/2015 | Naito | H01R 27/00 |
| 9,147,972 | B2 * | 9/2015 | Ohmura | H01R 13/641 |
| 2004/0161961 | A1 | 8/2004 | Endo | |
| 2005/0227541 | A1 * | 10/2005 | Garcia | H01R 33/09 439/619 |
| 2008/0272695 | A1 | 11/2008 | Misiaszek et al. | |
| 2014/0377970 | A1 * | 12/2014 | Crovetti | H01R 13/5213 439/131 |
| 2015/0062952 | A1 * | 3/2015 | Lessard | F21S 48/1208 362/549 |

FOREIGN PATENT DOCUMENTS

| | | |
|---|---|---|
| WO | 2014094706 | 6/2014 |

OTHER PUBLICATIONS

Co-filed U.S. Appl. No. 14/689,720, filed Apr. 17, 2015 on behalf of Osram Sylvania Inc.

Product data sheet of ERNI MiniBridge—Koshiri Single Row connector, Catalog E 074650, available at www.erni.com dated Aug. 2014 (4 pages, color).

* cited by examiner

*Primary Examiner* — Alexander Gilman

(74) *Attorney, Agent, or Firm* — Edward S. Podszus

(57) ABSTRACT

Retainer clip (100) attachable to automotive headlamp (10) for inhibiting second electrical connector (72) of wiring harness (44) from unintentionally separating from mating first connector (52) on the PCB (60) of the lamp. Clip (100) has central first beam (110) to contact lamp (10), lamp-retaining support base (160) depending from one end of first beam (110) to engage lamp (10), and second connector-blocking region (140) extending from an opposite end of first beam (110) that, upon assembly proximate second connector (72), inhibits separation of the connectors (52, 72). Clip (100) is stamped from sheet metal. Support base (165) has engaging arms (164, 166) joined by bight (162) either to be clipped over one fin (22) of heat sink (20) or to be squeezed between two neighboring fins (22). Engaging arms (164, 166) have protruding barbs (165) to resist separation of support base (165) from heat sink (20).

20 Claims, 6 Drawing Sheets

CLIP FOR WIRE HARNESS

CROSS REFERENCE TO RELATED APPLICATIONS

N/A

TECHNICAL FIELD

The present disclosure relates to a clip attachable to a lamp for inhibiting an electrical connector of a wiring harness from unintentionally separating from a mating connector on the lamp. More particularly, it relates to a stamped sheet metal dip attachable to a heat sink, preferably heat sink ribs, of an automotive headlamp to augment retention force provided by the conventional locking latch on the harness connector that is attached to a printed circuit board (PCB) header attached to a PCB.

BACKGROUND

Conventional electrical connectors such as sold by the company ERNI Electronics known in the trade as mini-bridge connectors, some of which are known as Koshiri-type mini-bridge connectors, have a header attached to a PCB and a connector attached to a wire harness that matingly engage via a selectively releasable plastic latch, shown in PCT WO 2014/094706 (Lappoehn) and herein as first and second connectors 52, 72 at e.g. FIG. 3. Common mini-bridge connectors can provide approximately 20 N of retention force resisting disconnection. Such a header connector is usefully attached to an automotive LED headlamp of the type shown in US Pat. Appln US 2015/0062952 (Lessard; Plaza; Seymour), in particular with reference to FIGS. 9-10 therein, as attached to the PCB shown as reference numeral 46. Under some circumstances it is desirable to increase the retention force over that provided by such mating connectors themselves.

Sheet metal clips are known in the lamp art, for example U.S. Pat. No. 8,319,411 (Kling); U.S. Pat. No. 7,993,162 (Scholeno); U.S. Pat. No. 7,731,545 (Scholeno) and Pub. Appln. US 2008/0272695 (Misiaszek). Also known is U.S. Pat. No. 7,364,371 (Tomikawa). Clips for mounting electronic components are known in U.S. Pat. No. 5,917,701 (Solberg) and U.S. Pat. No. 5,343,362 (Solberg).

BRIEF DESCRIPTION OF THE DRAWINGS

Reference should be made to the following detailed description, read in conjunction with the following figures, wherein like numerals represent like parts.

For a thorough understanding of the present disclosure, reference is made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION INCLUDING BEST MODE OF A PREFERRED EMBODIMENT

Figure 3:
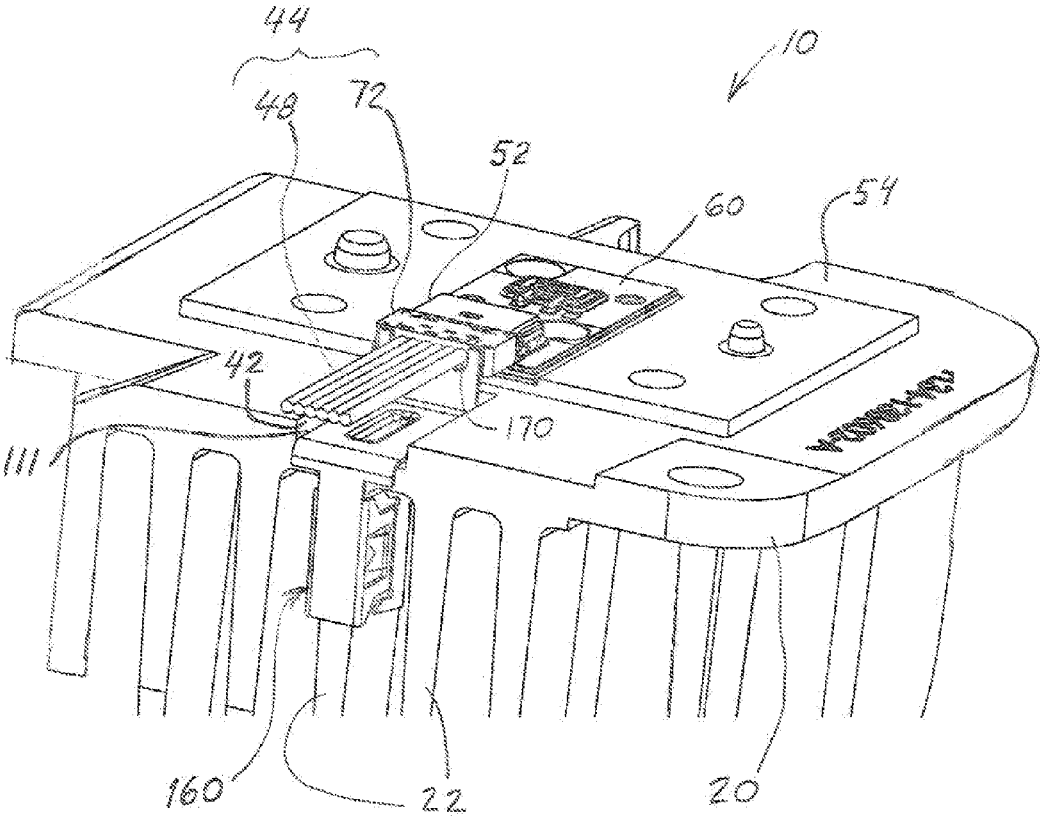
FIG. 3 depicts the clip of FIG. 1 secured to lamp 10 adjacent second connector 72.

By way of introduction, briefly referring to FIG. 3, exemplary retainer clip 100 of the present disclosure secures an electrical connection formed by first connector 52 and second connector 72, where first connector 52 and second connector 72 form what is be referred to in the art as a "wire-to-printed-circuit-board" connection, or more simply a "wire-to-board" connection. As such, retainer clip 100 may be used in a host of applications which make use of wire-to-board connections, which may include electronic devices, computer devices and motor vehicle devices to name a few.

Figure 1:
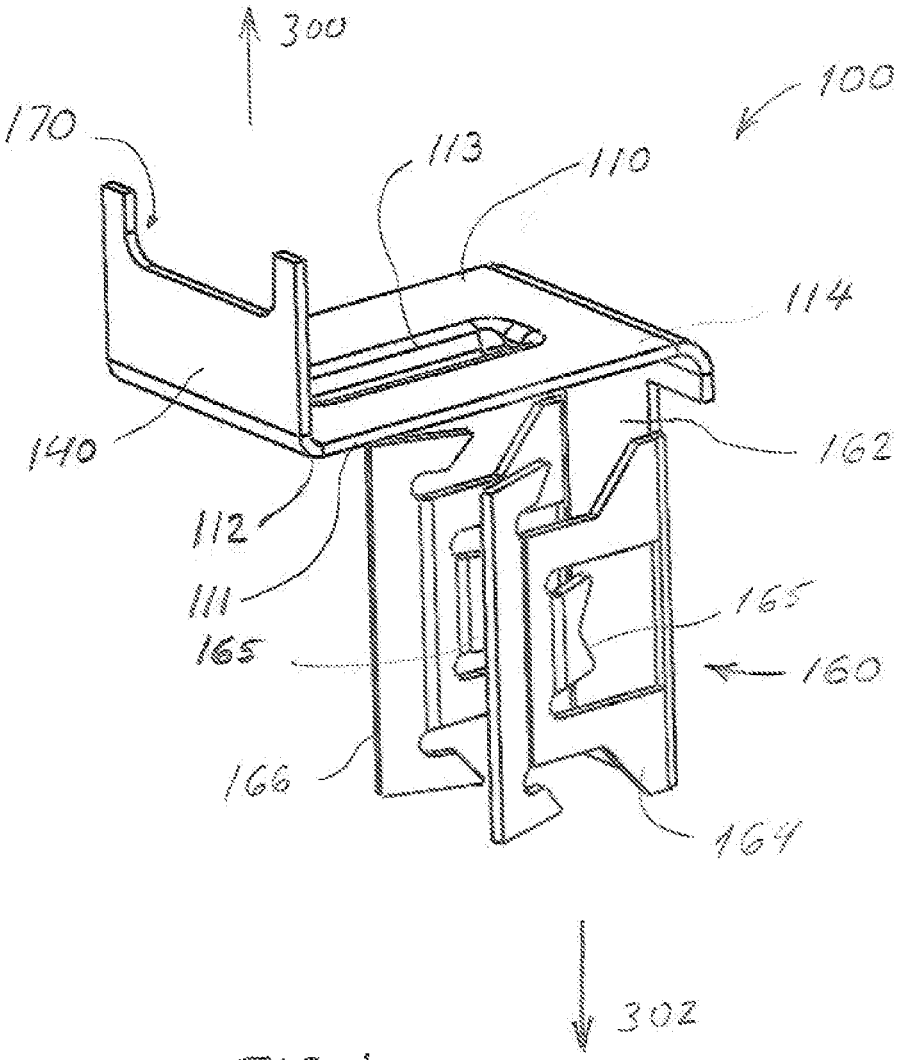
FIG. 1 is a front perspective view of retainer clip 100.
Figure 2:
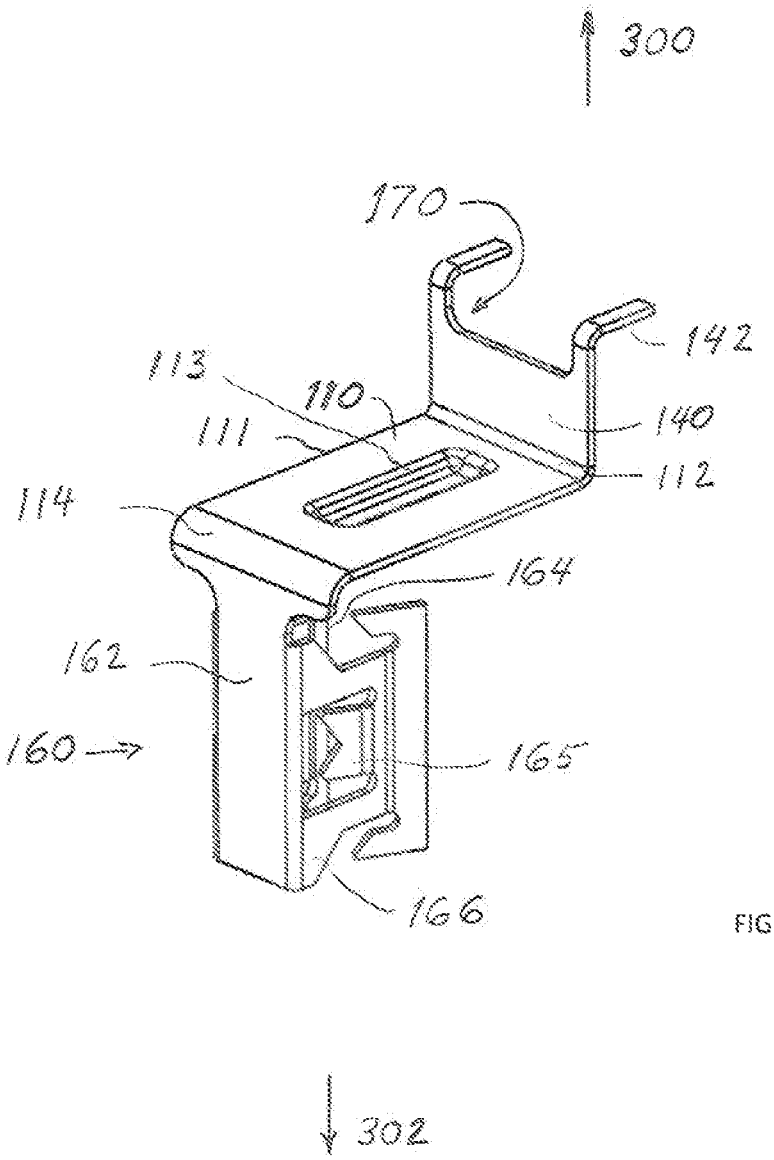
FIG. 2 is a rear perspective view of the retainer clip 100 similar to that of FIG. 1 with optional additional wings 142.

An exemplary clip 100 for retaining a connector 72 of wiring harness 44 is shown in FIGS. 1 and 2. As shown in FIG. 3, wiring harness 44 has a plurality of electrical wires 48 coupled to second connector 72 for supplying electrical power to an LED (light-emitting diode) light source mounted on PCB 60 that forms part of a vehicle headlamp. As shown in FIGS. 1-2, the clip 100 overall loosely resembles a modified letter "Z" with the middle beam of the "Z" being vertical rather than slanted, and having three main beam portions 140, 110, 160, in which preferably the two opposite marginal beam portions 140, 160 are generally orthogonal to the central beam portion 110, and extend in opposite directions 300, 302 away from central first beam portion 110. Clip 100 is preferably an integral, or unitary (one-piece), sheet metal stamping, such as from grade 304 stainless steel. Alternatively clip 100 could be molded of a plastics material, or a glass filled (GF) polymer, having sufficient stiffness.

FIG. 3 shows a known printed circuit board header has first connector 52 mounted on PCB 60. This permits a supply of electrical power to an LED mounted thereon, as is shown in Patent Appln. Pub. US 2015/0062952 (Lessard et al.) at FIGS. 9-10 therein. Patent Appln. Pub. US 2015/0062952 is incorporated herein by reference as if fully set in the present application. A known second connector 72 matingly and selectively releasably latches to first connector 52, preferably along a connection plane extending parallel to plurality of wires 48, such connection plane being also generally normal to the mutally mating faces of connectors 52, 72.

Figure 4:
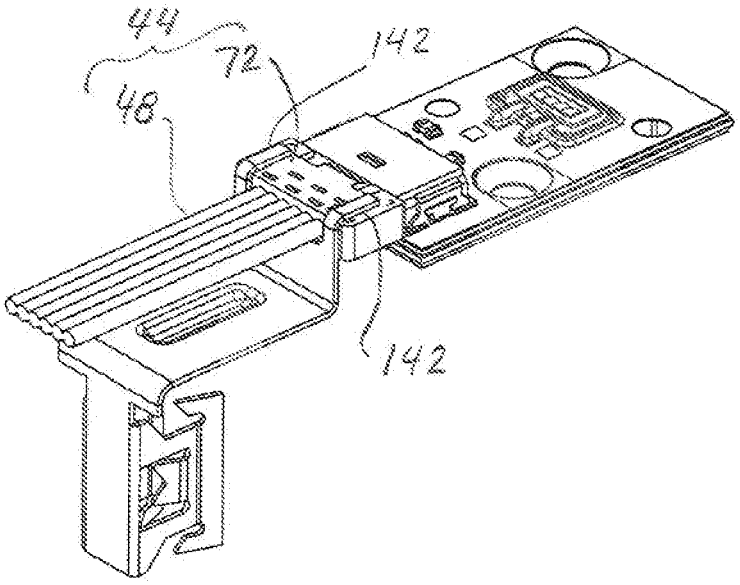
FIG. 4 is a detail view of the clip of FIG. 2 in a position as secured to lamp 10 and adjacent second connector 72 but omitting lamp 10.

Central first beam 110 has two opposed longitudinal ends, first end 112 and second end 114. First beam 100 has opposed marginal lateral edges 111. Clip region 140 is configured, in an assembled situation, to block second connector 72 of wiring harness 44, by being located proximate to second connector 72, as shown in FIG. 3. Clip region 140 can be referred to as second connector-blocking region 140. Second connector-blocking region 140 extends in a first direction 300 generally upward from first longitudinal end 112 of first beam 110. Second connector-blocking region 140 can be generally planar, and is generally perpendicular to first beam 110. Second connector-blocking region 140 preferably abuts second connector 72. Second connector-blocking region 140 preferably can also, in a condition of clip 100 being assembled to lamp 10, be pushed up against or urged against second connector 72 when the lamp-retaining support base 160 region of clip 100 is firmly secured to lamp 10. Second connector-blocking region 140 defines aperture 170 along a distal (upper) marginal edge thereof, through which, when assembled to lamp 10, wires 48 of wiring harness 44 have clearance to pass, as shown in FIGS. 3 and 4. Alternatively, if aperture 170 were inboard and bounded on all sides like a closed hole (not shown), then wires 48 would first be passed through aperture 170 before assembling clip 100 to lamp 10.

Support base 160 of clip 100 depends from first beam 110 extending in a second direction 302 generally downward from second longitudinal end 114 of first beam 110. In particular, support base 160 has a spine or second beam 162 that extends downward from first beam 110, and has features connected to second beam 162 that can be securely engaged to lamp 10, as shown in FIG. 3. Second beam 162 extends generally opposite to second connector-blocking region 140, and is conveniently formed generally parallel to second connector-blocking region 140. Second beam 162 is preferably generally perpendicular to first beam 110. In particular embodiments, second-connector blocking region 140 is parallel second beam 162, and each is perpendicular to first beam 110.

First beam 110 optionally has strengthening feature 113 formed therein, such as a bead, as is known in the metal forming art to increase a local moment of inertia to make it stiffer, as shown in FIG. 1. First beam 110 can also be formed without such strengthening feature 113. First beam 110 can be generally flat and planar. Even when first beam 110 contains strengthening bead 113, first beam 110 is generally tangent to a planar surface, e.g. first beam 110 can easily be placed upon a flat surface. First beam 110 is shaped to conform to guide channel 42 of heat sink 20. As seen in FIG. 3, guide channel 42 can be formed in heat sink 20 of the vehicle headlamp, the guide channel 42 being generally a flat, track-like surface. First beam 110 is sufficiently flat, or tangent to a planar surface, that is abuts guide channel 42.

Securement of lamp-retaining support base 160 to lamp 10 is achieved by wedging or clipping to suitable surface features formed in lamp 10, in particular those formed in heat sink or bracket 20 upon which PCB 60 is mounted at heat sink upper surface 54. Less preferred would be adhesively securing clip 100 to a portion of lamp 10. When formed from cast aluminum or other suitable heat-transferring material, heat sink 20 conducts heat away from an LED light source, or other heat-generating electronic component, mounted on PCB 60 and dissipates heat by one or more depending fin or rib 20, preferably a series of ribs 22. Support base 160 preferably has resilient engaging arms 164, 166 extending from second beam 162. Second beam 162 forms a bight joining the pair of engaging arms 164, 166. FIGS. 1-2 show engaging arms 164, 166 extend in a direction generally from second longitudinal end 114 toward first longitudinal end 112 as seen along first beam 110, that is, towards second connector-blocking region 140. FIG. 1 or 2 shows engaging arms 164, 166 are generally perpendicular to second beam 162.

In operation, as seen in FIG. 3, first and second engaging arms 164, 166 can be clipped onto a protuberance in lamp mounting bracket 20 such as being clipped over one depending heat sink fin 22. A lateral distance between engaging arms 164, 166 is undersized compared to a width of fin 22, so arms 164, 166 exert a clamping force on fin 22. In an alternative embodiment of FIG. 6, engaging arms 164, 166 are wedged into a cavity defined in lamp mounting bracket 20, such as being squeezed together and inserted between adjacent fins or ribs 22 so that their tendency to expand outward secures clip 100 to lamp 10. The width of bight or second beam 162, as well as angle and elasticity of engaging arms 164, 166, is chosen to suitably clamp onto rib 22 or between adjacent ribs 22 with appropriate retention force, as is understood by one of skill in the art.

Figure 5:
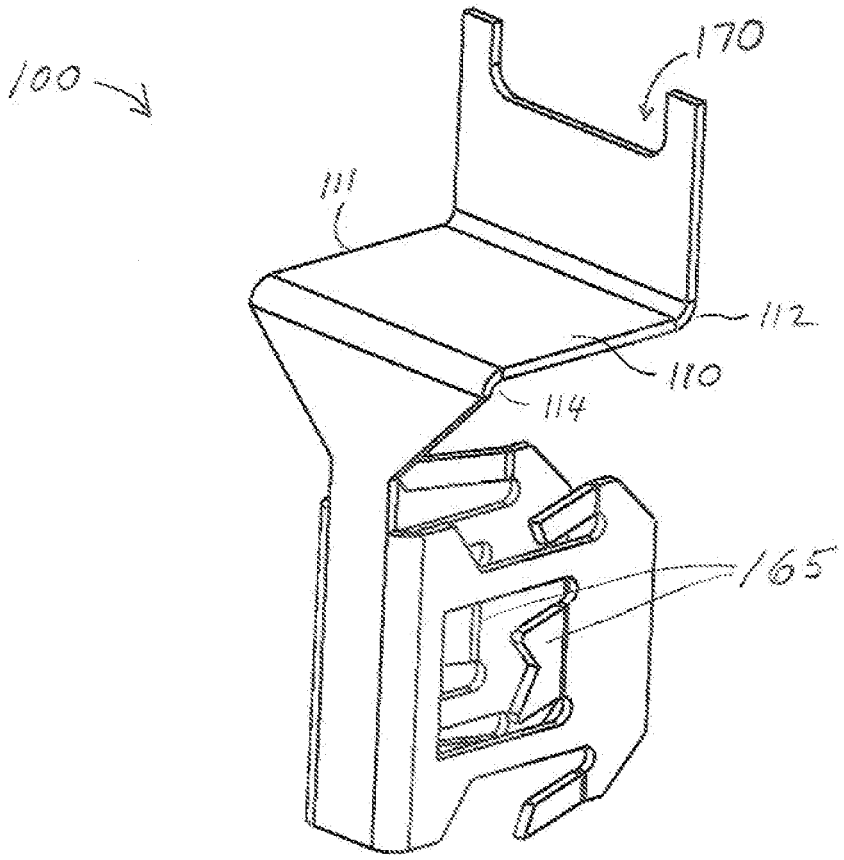
FIG. 5 shows retainer clip 100 having an alternate embodiment of barbs.

Securement of engaging arms 164, 166 to a portion of lamp 10 is enhanced with optional barb or barbs 165 projecting out of one or both engaging arms 164, 166. Each barb 165 can be stamped out of the same sheet metal as the respective engaging arm 164, 166 on which it is carried, and can have a generally sharp toothed or pointed free distal (terminal) edge as shown in FIG. 1, 2 or 5. Each barb 165 acts as a small cantilever beam. The barbs 165 are designed to flex during insertion of retainer clip 100, in particular support base 160 and its engaging arms 164, 166, over rib 22. Then subsequently a force applied in the opposite direction to insertion will tend to cause barb 165 to dig into heat sink 20 and provide additional retention force, thus further inhibiting separation of second connector 72 away from first connector 52. Abutment of one clip lateral edge 111 against a surface of guide channel 42, forming a first pair of cooperating features, and one barb 165 urged against a fin 22, forming a second pair of cooperating features, promotes engagement of clip 100 on lamp 10.

FIGS. 1 and 2 show retainer clip 100 having barbs 165 that are mutually inclined inward towards each other (and rearwardly away from second connector-blocking region 140), which is advantageous for use with the attachment of clip 100 over one heat sink fin or rib 22 in the position shown in FIG. 3 or 4. Barbs 165 are inclined "inward" in the sense of into a spatial volume bounded between the pair of engaging arms 164, 166.

Figure 6:
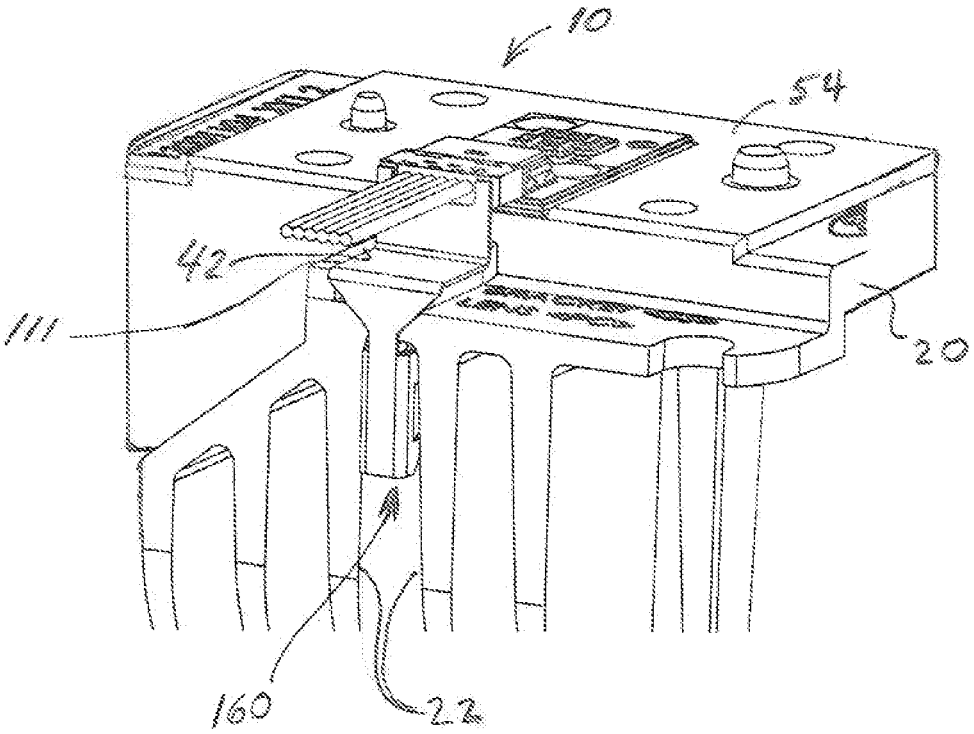
FIG. 6 depicts the clip of FIG. 5 secured to lamp 10 adjacent second connector 72.

FIG. 5 shows an embodiment of retainer clip 100 having barbs 165 mutually inclined outward from each other (and rearwardly away from second connector-blocking region 140), which is advantageous for use with the attachment of clip 100 between two adjacent heat sink fins 22 in the position as shown in FIG. 6. Barbs 165 are inclined "outward" in the sense of away from a spatial volume bounded between the pair of generally parallel engaging arms 164, 166. In the FIG. 5 embodiment, first beam 110 is shorter than in embodiment shown in FIG. 1 or 2, so as to be adapted to a length along heat sink upper surface 54 from an edge of heat sink 20 inward to be in abutting facing relation to second connector 72.

FIG. 2 shows, advantageously, one or more wings 142 along the upper, distal margin of second connector-blocking region 140, preferably one wing 142 at each opposed lateral edge. The position of wings 142 as folded-over is set during the metal stamping operation so as to cover wiring harness connector 72, when considered in an orientation of clip 100 assembled to (clipped to) lamp 10 as shown in FIG. 4 (lamp 10 omitted to show detail), in order to reduce possible breakage during an event of an upward force applied to wiring harness 44 such as could be exerted when lamp 10 is installed in a motor vehicle if a force were applied to wires 48 pulling upwardly away from PCB 60 and away from fins 22, where such an un-opposed force might otherwise break first header connector 52 on PCB 60.

As shown in FIG. 3, advantageously clip 100, when engaged to bracket/heat sink 20, is supported against lateral displacement by having its central first beam 110 received along guide channel 42 defined on upper surface 54 of heat sink 20. Guide channel 42 can have an open, rectangular cross-section that is recessed below upper surface 54 as in FIG. 3. Alternatively as in FIG. 6, guide channel 42 can be defined by a corner edge along a protuberance on upper surface 54. Clip first beam 110 has two opposed lateral edges 111 configured to cooperate with guide channel 42. When one lateral edge 111 (as in FIG. 6), or both lateral edges 111 (as in FIG. 3), abut guide channel 42, second connector-blocking region 140 is further aligned with second connector 72 and wire-receiving aperture 170 is further aligned with wires 48.

A computer static simulation of retainer dip 100 using finite element analysis performed on SolidWorks software (available from Dassault Systemes), assuming clip 100 being formed generally as shown in FIG. 1 from 0.45 mm (0.018 inch) thick stainless steel flat stock, showed a deflection of approx. 1.14 mm, seen at the tip of the clip (upper region of second connector-blocking region 140 highest above first beam 110) to a 50 N applied load to the connector contact surface, such that dip 100 would remain adequately connected to lamp 10 with this amount of deflection deemed tolerable, to assist maintaining adequate connection between wiring harness second connector 72 and first connector 52. Thus clip 100 additionally inhibits separation of known connectors having mating latches, especially known interfit connectors that would provide less than 50 N retention force. Simulation indicated the deflection can be reduced by shortening the height of tips of second connector-blocking region 140 above first beam 110, for example a 2 mm height reduction would lead to the deflection reduced to 0.72 mm.

Advantageously, clip 100 can be readily retrofit onto serviced lamps in the field that were originally supplied into vehicles without clip 100 but whose conventional mating connectors are deemed to provide insufficient retention force. Clip 100 can simply be engaged to heat sink 20 without disassembling lamp 10, or even disconnecting connectors 52, 72. Attachment of wire harness clip 100 does not require changes to lamp 10 or the known wire harness 44 to provide enhanced retention force by physically blocking removal of second connector 72. Harness clip 100 can be attached to lamps 10 previously assembled into motor vehicles or those still in uninstalled inventory. Clip 100, once assembled, can as desired be removed with a simple manual tool, such as a pliers or pincer that grasps second beam 162, using sufficient but moderate manual force, by pulling clip 100 away from fin 22, thus then permitting second connector 72 to be pulled from first connector 52 in the usual manner.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, are understood to mean "at least one." The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

An abstract is submitted herewith. It is pointed out that this abstract is being provided to comply with the rule requiring an abstract that will allow examiners and other searchers to quickly ascertain the general subject matter of the technical disclosure. It is submitted with the understanding that it will not be used to interpret or limit the scope or meaning of the claims, as set forth in the rules of the U.S. Patent and Trademark Office.

The following non-limiting reference numerals are used in the specification:

10 vehicle headlamp
20 bracket/heat sink
22 rib or fins
42 guide channel
44 wiring harness
48 electrical wires
52 first connector
54 heat sink upper surface
60 printed circuit board (PCB)
72 second connector
100 retainer clip
110 first beam
111 lateral edge of clip
112 first longitudinal end of first beam 110
113 strengthening bead
114 second longitudinal end of first beam 110
140 second connector-blocking region
142 wing
160 lamp-retaining support base
162 second beam
164 first engaging arm
165 barb
166 second engaging arm
170 aperture in second connector-blocking region
300 first direction ("upward")
302 opposite second direction ("downward")

What is claimed is:

1. A retainer clip (100) to secure an electrical connection of a first connector (52) of an automotive lamp (10) and a second connector (72) of a wiring harness (44) configured to mate with each other to establish the electrical connection, the retainer clip comprising a first beam (110) configured to contact said lamp (10) and having opposed first and second longitudinal ends (112, 114);

a second connector (72)—blocking region (140) connected to said first beam (110) at said first longitudinal end (112) and extending in a first direction (300) away from said first beam (110), said second connector blocking region (140) configured, upon assembly thereof proximate the second connector (72), to inhibit separation of the first connector (52) and a second connector (72); and a lamp (10)—retaining support base (160) depending from said first beam (110) at said second longitudinal end (114) and extending in a second direction (302) opposite said first direction (300), said support base (160) configured to engage to the automotive lamp (10).

2. The retainer clip (100) of claim 1, wherein the support base (160) further comprises a second beam (162) and first and second resilient engaging arms (164, 166) in facing relation to one another, said engaging arms (164, 166) being configured to engage a portion of said lamp (10).

3. The retainer clip (100) of claim 2, wherein said second beam (162) is generally perpendicular said first beam (110), and said engaging arms (164, 166) extend generally perpendicular from said second beam (162).

4. The retainer clip (100) of claim 2, wherein said second beam (162) defines a bight joining said pair of engaging arms (164, 166).

5. The retainer clip (100) of claim, 1 wherein the automotive lamp (10) comprises a guide channel (42); and the first beam (110) includes a lateral edge (111) configured to cooperate with the automotive lamp (10) to align the second connector-blocking region (140) with the second connector (72) by arranging the lateral edge (111) in the guide channel (42) of the automotive lamp (10).

6. The retainer clip (100) of claim 1, wherein said second connector-blocking region (140) further comprises on a distal region thereof at least one wing (142) extending away from a plane of the second connector-blocking region (140) and configured to overlie an upper surface of said second connector (72).

7. The retainer clip (100) of claim 1, wherein said second connector-blocking region (140) extends generally perpendicular to said first beam (110).

8. The retainer clip (100) of claim 1, wherein the clip (100) is formed of resilient sheet metal.

9. The retainer clip (100) of claim 2, wherein said engaging arms (164, 166) extend in a direction towards said first longitudinal end (112).

10. The retainer clip (100) of claim 2, wherein at least one said engaging arm (164, 166) further comprises a barb (165) extending out of a plane of the respective engaging arm.

11. The retainer clip (100) of claim 10, wherein each said engaging arm (164, 166) comprises a said barb (165), and said barbs (165) are mutually inclined, so as to inhibit separation of said support base (160) when clamped to said lamp (10).

12. The retainer clip (100) of claim 2, wherein said second connector-blocking region (140) extends generally parallel said second beam (162).

13. The retainer clip (100) of claim 12, wherein said second connector-blocking region (140) extends generally perpendicular to said first beam (110).

14. The retainer clip (100) of claim 1, wherein said second connector-blocking region (140) further defines an aperture (170) configured to accommodate a plurality of wires (48) of the wiring harness (44).

15. The retainer clip (100) of claim 1, wherein the automotive lamp (10) comprises a mounting bracket and/or heat sink (20) and at least one rib (22) depending from said mounting bracket and/or heat sink (20); and said support base (160) is configured to engage said at least one rib (22).

16. The retainer clip (100) of claim 15, wherein said support base (160) further comprises a pair of resilient engaging arms (164, 166) joined at a bight (162), said engaging arms (164, 166) being in spaced relation and configured to clamp said at least one rib (22).

17. The retainer clip (100) of claim 15, wherein said at least one rib comprises a plurality of ribs (22); and said support base (160) further comprises a pair of resilient engaging arms (164, 166) joined at a bight (162), said engaging arms (164, 166) being in spaced relation configured to clamp between adjacent ribs (22).

18. The retainer clip (100) of claim 1, wherein said first beam (110) is generally tangent to a plane.

19. The retainer clip (100) of claim 18, wherein said first beam (110) includes a strengthening feature (113).

20. The retainer clip (100) of claim 1, wherein said first beam (110) is generally planar.

* * * * *